United States Patent [19]

Lane et al.

[11] Patent Number: 4,557,379

[45] Date of Patent: Dec. 10, 1985

[54] CIRCUIT BOARD PACKAGE AND METHOD OF MANUFACTURE

[75] Inventors: Richard J. Lane; Kurt L. Rozek, both of Dallas, Tex.

[73] Assignee: Lane Container Company, Dallas, Tex.

[21] Appl. No.: 608,381

[22] Filed: May 9, 1984

Related U.S. Application Data

[63] Continuation-in-part of Ser. No. 562,477, Dec. 16, 1983, abandoned.

[51] Int. Cl.[4] ..... B65D 73/02; B65D 85/30; H05F 3/00; H05F 3/02

[52] U.S. Cl. ..... 206/328; 206/334; 361/212

[58] Field of Search ..... 206/328, 334, 444, 454; 229/2.5, 45; 220/339; 361/212

[56] References Cited

U.S. PATENT DOCUMENTS

| | | | |
|---|---|---|---|
| 3,084,842 | 4/1963 | Beech | 229/2.5 |
| 3,164,478 | 9/1965 | Bostrom | 229/2.5 |
| 3,489,265 | 3/1970 | Puente | 220/339 |
| 3,615,006 | 10/1971 | Freed | 206/454 |
| 3,696,054 | 4/1972 | Saunders | 252/511 |
| 3,786,982 | 1/1974 | Rakes et al. | 229/45 |
| 4,154,344 | 7/1979 | Yenni, Jr. et al. | 206/328 |
| 4,160,503 | 7/1979 | Ohlbach | 206/328 |
| 4,211,324 | 4/1980 | Ohlbach | 206/328 |
| 4,238,030 | 12/1980 | Maylandt | 206/444 |
| 4,293,070 | 9/1981 | Ohlbach | 206/328 |
| 4,308,953 | 12/1982 | Cohen | 206/334 |
| 4,427,114 | 6/1984 | Howell et al. | 206/334 |

OTHER PUBLICATIONS

Conductive Packaging Corporation Product Literature (5 sheets).

*Primary Examiner*—William T. Dixson, Jr.
*Attorney, Agent, or Firm*—Hubbard, Thurman, Turner & Tucker

[57] ABSTRACT

A thermoformed structural foamed plastic container for electrical circuit boards and the like is provided with a conductive outer surface to dissipate electrostatic charges which can adversely affect the circuit elements disposed within the container. The container is preferably formed of integrally joined clamshell sections which are connected by an integral hinge and are provided with suitable support bosses and the like for securing an electrical circuit element within the package interior. The entire exterior or interior surface of the container is provided with a spray or brush deposited or vacuum applied conductive coating comprising carbon or other metallic substances. The container may be formed in two separate sections joined together with interlocking tabs and slots which provide electrically conductive engagement between the container sections. The container is preferably formed by thermoforming extruded foamed plastic sheet, spraying a solvent or water base electrically conductive coating onto the exterior and/or interior surfaces of the container, die cutting the container to its finished shape and coating the entire exposed surface of the container with an antistatic charge coating to provide a mass produceable, low cost package.

24 Claims, 10 Drawing Figures

CIRCUIT BOARD PACKAGE AND METHOD OF MANUFACTURE

CROSS-REFERENCE TO RELATED APPLICATION

This application is a continuation-in-part of our prior application Ser. No. 562,477, filed: Dec. 16, 1983, now abandoned.

BACKGROUND OF THE INVENTION

1. Field of the Invention

The present invention pertains to a package for circuit boards and other electronic assemblies having a continuous conductive surface thereon to protect the package contents against electrostatic discharge. The package is manufactured from plastic sheet on which a conductive substance is deposited over substantially the entire outer and/or inner surface of the package.

2. Background

The development of microelectronic circuits and devices utilized in such circuits, including metal oxide semiconductors, transistors and other devices, has created a serious problem in the handling, shipping and storage of various circuit devices, including printed circuit boards, due to the generation of static electricity. The buildup of electrostatic charges on various elements such as packaging and virtually any object which comes into contact with microelectronic circuits can cause critical damage to the circuits which can remain undetected until the circuit is placed in use or can shorten the useful life of such circuits. The electrostatic charges can, of course, originate in various ways but the ordinary handling of electronic circuit boards and other devices through movement of the device by mechanical means or by the person manufacturing or installing the device can result in serious electrical damage to circuit components.

To this end there have been efforts to develop packaging and handling devices which are provided with a conductive surface to constantly drain away or prevent the buildup of an electrostatic charge on the package or to prevent the transfer of a charge on an object which comes into contact with the package to the circuit element contained in the package.

The large scale manufacture of various types of microelectronic circuit boards and other devices has accentuated the need for low cost reliable packaging in which circuit boards and other elements can be shipped, stored and otherwise handled without risk of damaging the circuit from electrostatic discharges. The package should, of course, provide the function of supporting and protecting the circuit from physical damage due to impact of the package with other objects during its handling and shipping. The package should also be capable of large scale, low cost manufacture and, in particular, it has been determined that the package must be capable of being provided with a continuous electrically conductive surface which will adequately shield the contents of the package from electrostatic discharges.

Although various packages have been developed for storing and shipping electronic printed circuit boards and other microelectronic devices, one of the major problems with prior art packages is the failure to provide a container which is structurally simple and low cost of manufacture, which is adapted to support the electronic device packed therein to permit relatively little or no movement of the device within the package, be capable of absorbing relatively high impact loads from dropping the package or from striking the package with other objects and be reliable as regards the conductivity of static charges to prevent a charge buildup on a portion of the package which may eventually come into direct contact with the circuit board or through another conductive element such as the person handling the circuit board on removal from the package. The provision of paperboard packages which have been coated on an inside or outside surface are not entirely satisfactory since the packages must be glued or mechanically fastened together to form a suitable enclosure thus introducing the possibility of forming a discontinuity in the conductive surface of the package. Known types of packages, including paper or particle board packages or packages requiring conductive insert type structures for supporting the packaged device, are also not capable of high volume, low cost manufacture. Those types of packages requiring conductive material insert members also require additional space to accommodate the insert structure which adds to package shipping and storage costs. Accordingly, there has been an unfilled need for an electrically conductive package for storing and shipping electronic circuit elements and similar devices and which has all of the features and advantages described herein.

SUMMARY OF THE INVENTION

The present invention provides an electrically conductive shipping and storage package for electronic circuit boards or other circuit devices which is capable of securely containing the device within the package structure, and is provided with a coninuous electrically conductive surface on the package to prevent the buildup of an electrostatic charge, or the transmission of such a charge to the device contained within the package. The package is characterized by a container which is preferably formed of a high impact absorbing plastic which is capable of absorbing and dissipating physical or mechanical shock or impact without transferring damaging impacts to the device contained therein.

In accordance with one aspect of the present invention, thereis provided a package comprising a circuit board storage and shipping container which is formed of relatively inexpensive materials and preferably of extruded solid or foamed impact resistant plastics capable of being thermoformed into the desired configuration for supporting a circuit device or the like to prevent physical damage to the device during shipping and storage. The container is also provided with a conductive subtance on a surface of the container which is continuous and substantially envelopes the circuit device or devices contained within the package to prevent electrical discharges which could adversely affect the contents of the package.

In accordance with another aspect of the present invention, there is provided a package for containing electrical circuit boards and similar microelectronic devices which is formed of extruded polystyrene plastic which may be thermoformed into a specific selected package configuration for supporting a specific circuit device and which is capable of low cost mass production. In particular, the package is formed as a closable container having opposed clamshell sections which are integrally formed with each other and provided with an integral hinge for folding the opposed container sections over toward each other to form an integral supporting enclosure for the device or devices to be shipped in the package. The container is provided with a continuous electrically conductive path on a surface of the container to prevent the accumulation of an electrostatic charge and to prevent the transmission of the charge to the package contents. The container does not require extra space to receive supportive insert structures and may be stored and shipped prior to use in a nested configuration to conserve space and reduce costs.

In accordance with yet a further aspect of the present invention, there is provided a thermoformed plastic, electrically conductive container for shipping and storing electrical circuit devices which has an electrically conductive coating formed as a continuous surface over the entire surface of the container to provide a conductive path to prevent the accumulation of an electrostatic charge and to minimize the transmission of an electrical charge through the package and the contents thereof. The conductive coating is preferably formed by applying a conductive material to an exterior and/or interior surface of the container by the spraying or other suitable application of a conductive composition to the selected surface or surfaces. The conductive substance may be applied prior to or after the thermoforming of the container.

One embodiment of the invention is provided with a coating which covers the entire inner surface of the container, the entire outer surface of the container and the peripheral edges of the container to form a continuous conductive or antistatic surface to prevent the buildup of an electrostatic charge potential between the inner and outer surfaces of the container should one or the other of these surfaces be subject to a grounding connection. The coating may be applied to the container by spraying or dipping the container after a thermoforming and die cutting or other fabricating process is carried out to separate the container from a continuous sheet of material from which the containers are fabricated.

In accordance with still further aspects of the present invention, there is provided an improved manufacturing process for a unique storage container for electrical circuit devices and the like wherein high volume production of the container may be obtained at relatively low cost and an electrically conductive subtance is applied to the entire outer or inner surfaces of the container. Continuity of the conductive surface is maintained to provide a substantial conductive shield around the package contents when the container is closed to secure the contents therein.

The manufacturing process comprises the substantially continuous forming of thermoformed plastic containers from extruded foamed plastic sheet, which containers may precoated or coated during the manufacturing process by an electrically conductive coating over what becmes an entire outer and/or inner surface of the package, and the package is then finished formed through a die cutting or similar operation without forming a discontinuity in the conductive surface.

The embodiment of the container which is coated over the entire inner surface, outer surface and side edges is preferably formed in a continuous forming process wherein the containers are coated by dipping or spraying to provide a continuous coating which essentially encapsulates the entire container structure within a conductive or antistatic type coating substance.

The above mentioned features and advantages of the present invention as well as additional superior aspects thereof will be further appreciated by those skilled in the art upon reading the detailed description which follows in conjunction with the drawing.

DESCRIPTION OF THE PREFERRED EMBODIMENTS

Figure 1:
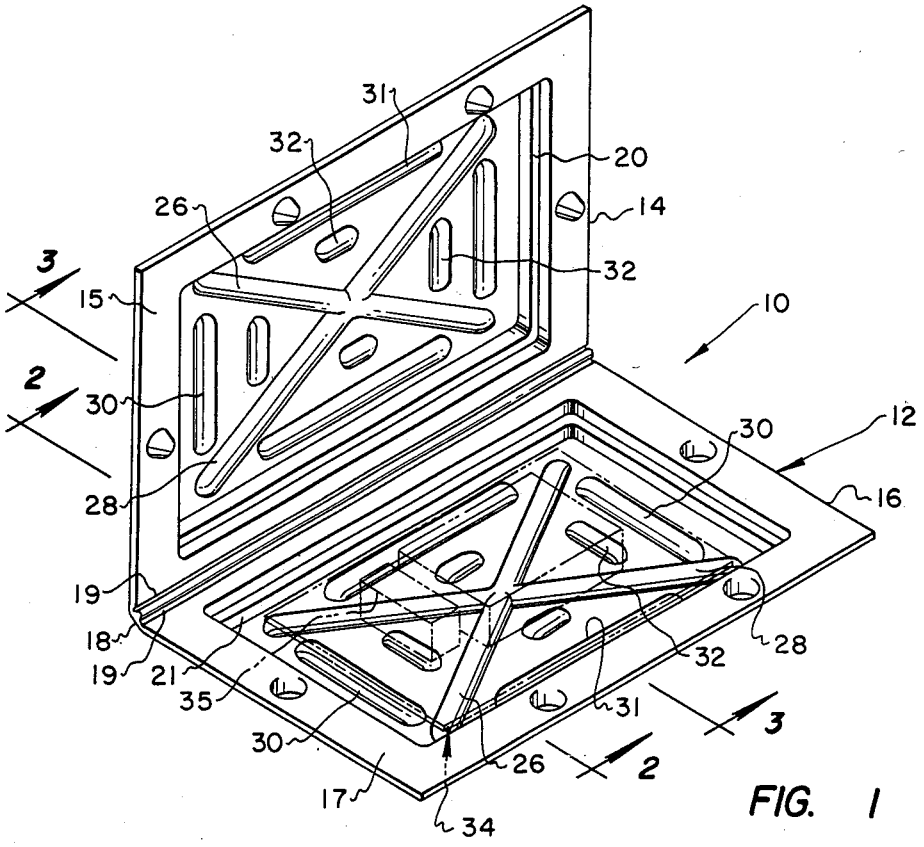
FIG. 1 is a perspective view of a circuit board shipping and storage container in accordance with the present invention.

In the description which follows, like parts are marked throughout the specification and drawing with the same reference numerals, respectively. The drawings are not necessarily to scale and certain features of the invention may be shown in schematic form or exaggerated in scale in the interest of clarity and conciseness.

Referring to FIG. 1, there is illustrated an electrically conductive package for storage and shipment of elements such as electrical circuit boards and other electrical devices which must be isolated from electrical discharges. The package of the present invention is generally designated by the numeral 10 and is preferably characterized as a substantially one piece thermoformed plastic container 12 having opposed clamshell like top and bottom sections 14 and 16 which are of similar configuration and are integrally joined by an integral hinge portion 18. The container 12 is preferably thermoformed of foamed plastic such as polystyrene which may be provided in the form of extruded sheets which are heated and formed in a suitable die apparatus as will be described further herein.

Figure 2:
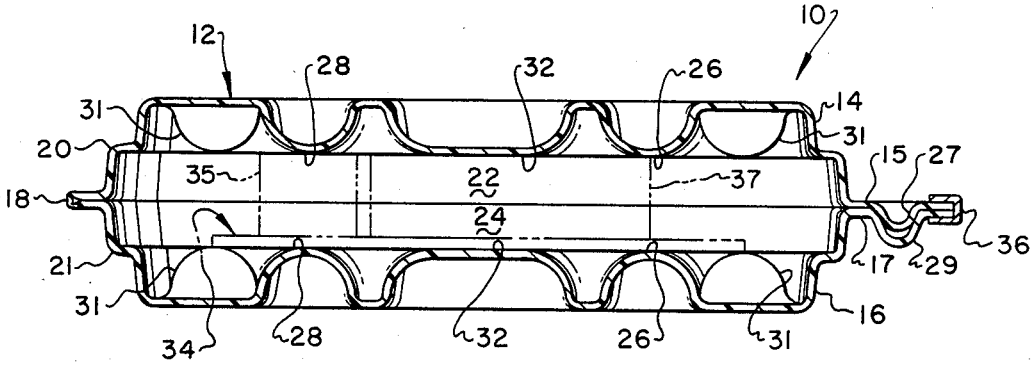
FIG. 2 is a transverse section view of the container of the present invention taken along Line 2—2 of FIG. 1 with the container in a closed condition supporting an electrical circuit board therein.

Referring to FIG. 2, also, the opposed top and bottom sections 14 and 16 of the container 12 are provided with displaced wall portions 20 and 21 forming respective recesses 22 and 24. Portions of the displaced walls 20 and 21 are further displaced in the opposite direction to form a plurality of raised surfaces or projections defined by exemplary bosses 26, 28, 30, 31 and 32 which are formed in identical patterns on the clamshell sections 14 and 16 to give strength to the container 12 and to serve as support surfaces for an electrical circuit device such as a microcircuit board 34, see FIG. 2. The bosses 26, 28, 30, 31 and 32 of each container section 14 and 16 may be located directly opposite each other when the container is in the closed position as illustrated in FIG. 2 for engagement with the circuit board 34 and certain elements formed thereon to support the board substantially fixed within the interior recesses 22 and 24. The circuit board 34 engages bosses 26, 28 and 32 of section 16, as shown in FIG. 2, and includes exemplary devices 35 and 37 engageable with the bosses 26, 28 and 32 on section 14. The circuit board 34 may, of course, be enclosed within a protective sheath or envelope such as a thin film plastic sack or the like, not shown, or may otherwise be supported within the interior chambers 22 and 24 by support means including plastic foam inserts and the like. However, in accordance with a particularly advantageous aspect of the package 10 of the present invention, the bosses 26, 28, 30, 31 and 32 or other similarly formed projections are adapted to support the circuit board 34 or any specific circuit device substantially rigidly within the package 10.

Figure 3:
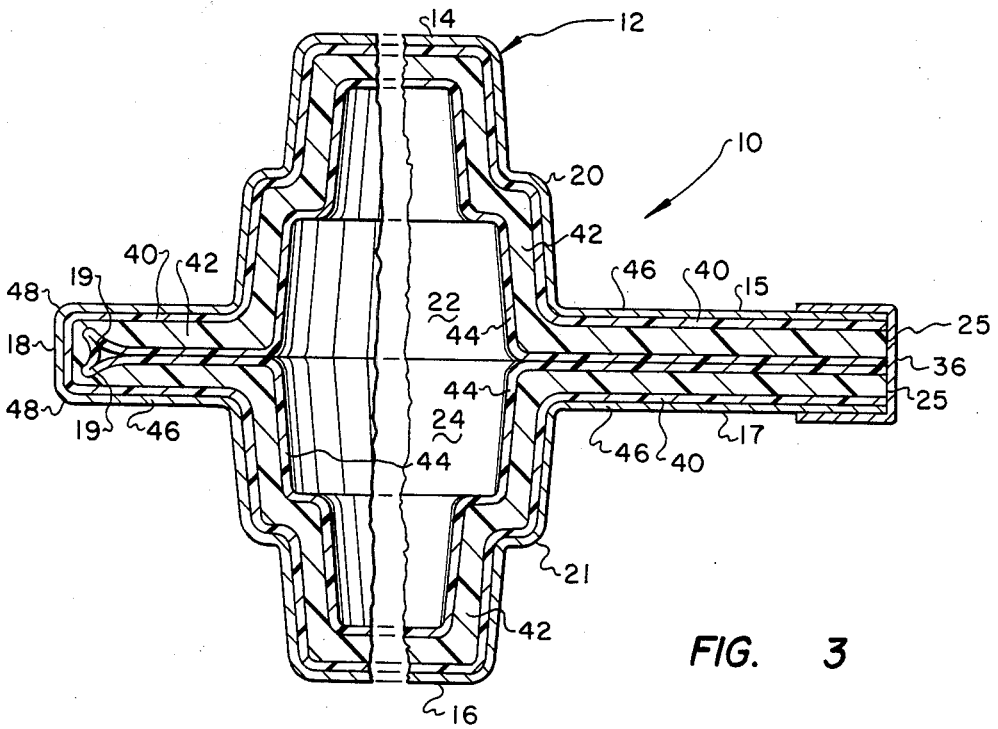
FIG. 3 is a detail section view of the container illustrated in FIG. 1 in a closed position, on a larger scale and taken along the line 3—3 of FIG. 1.

The formation of the recesses 22 and 24 in the opposed container sections 14 and 16 leaves generally peripheral flanges 15 and 17 for the respective clamshell container sections which are provided with complementary locating bosses 27 and recesses 29 formed in the respective sections 14 and 16 which are cooperable in the closed condition of the container to positively locate the container sections with respect to each other and to prevent relative movement of one section with respect to the other. As illustrated in FIGS. 2 and 3, the flanges 15 and 17 are secured to each other across opposed edges 25 by suitable fastener means which may comprise electrically conductive tape 36 or other suitable conductive or nonconductive fastener means. However, in accordance with the present invention, it is advantageous to use electrically conductive fastener means such as the tape 36, suitable clips, not shown, staples or other fastener means, not shown, to aid in providing a continuous electrically conductive shield over substantially the entire surface of the package 10 by assuring that the opposed container sections 14 and 16 are in electrically conductive engagement with each other.

In accordance with the present invention, the conductivity of the outer surfaces of the container sections 14 and 16 is assured by the provision of a conductive coating on the exterior surface of the container 12 which is uniformly distributed thereover and extends through the hinge section 18 so that virtually the entire exterior surface of the container is electrically conductive to prevent the accumulation of an electrostatic charge and to provide a conductive path for a charge imposed on the container 12.

Referring now to FIG. 3, there is illustrated a detailed cross-sectional view of the hinge section 18 of the container 12 and the flanges 15 and 17 at one point of connection of the flanges with each other such as by the electrically conductive tape 36. One outstanding advantage of the present invention is the provision of an electrically conductive circuit board shipment and storage package which is formed of a material which is able to withstand relatively severe impacts and to dissipate impact energy without damaging the contents of the package. In accordance with the embodiment of the container 12 illustrated in FIG. 3, the container is fabricated from thermoformed polystyrene plastic sheet having a relatively hard plastic outer sheet 40, a foamed core portion 42 and a relatively hard plastic inner sheet 44. The sheets 40 and 44 are suitably laminated to the core 42 and provided in a relatively compressed extruded sheet which may be heated and then thermoformed using a vacuum molding apparatus or a mechanical mold and die apparatus to displace the material to form a container shape as illustrated in FIGS. 1–3.

As shown in FIG. 3, the container 12 is provided with a continuous electrically conductive coating 46 applied to the outer surface of the sheet 40. The coating 46 may comprise a solvent or water base paint composition in which carbon particles are suspended in a suitable air hardenable binder. The coating 46 may also comprise a metallic coating which is vacuum deposited on the plastic sheet 40 or on a similar suitable substrate. The concentration of carbon or graphite particles in the coating 46 or the concentration of other metallic particles may be varied in accordance with the desired conductivity of the coating. Typically, the coating should have a resistivity less than $10^5$ ohms per square. Other types of coatings which may be applied to the sheet 40 or to a similar substrate comprise vacuum deposited metallic aluminum coatings. Moreover, the extrusion sheet which is used to form the container 12, may also be provided with a metallic laminate on the layer or sheet which forms the outer or inner surface of the package. The conductive coating may be applied before thermoforming of the package or thereafter depending on the nature of the coating and, in accordance with one preferred method of manufacturing the package 10 to be described herein, the coating is applied after the container sections 14 and 16 are formed and the integral hinge section 18 is defined by scoring the sheet which forms the container 12 by the formation of at least two parallel score lines 19, as indicated in FIGS. 1 and 3. By forming the score lines 19 on the inside surface of the container 12, the radii 48, FIG. 3, is formed on the outside surface of the hinge section 18 are fairly generous and minimize the risk of forming a break or discontinuity in the coating 46 whereby a continuous electrically conductive surface is provided over substantially the entire exterior surface of the package 10.

As mentioned previously herein in regard to certain advantages of the present invention, the package 10 is particularly adapted for storing and shipping electrical circuit elements in an electrostatically shielded manner and in a substantially mechanically isolated manner to prevent the transmission of impact loads directly to the contents of the package and to minimize structural failure of the package. The provision of the container 12 of a foamed plastic material assures a cushioning or impact absorbing characteristic. The plastic foam density, in the finished molded condition of the container 12, is varied to suit the weight of the item contained therein. By forming the container 12 to have an integral hinge 18 joining the opposed clamshell top and bottom container sections 14 and 16, an electrically conductive coating may be applied to the exterior, as well as interior surface, if desired, of the container 12 and the continuity of the electrically conductive coating is not interrupted at the hinge section 18 nor, in accordance with an improved method of the present invention, at any other section or portion of the clamshell sections 14 and 16. The container is, of course, well suited to very high volume mass production which is important considering the very large quantities of electrical circuit board and related components of various sizes which are manufactured, stored and shipped throughout the electronics industry. The formation of a one piece, integral hinge container with integral means for rigidly securing a circuit board therein and wherein the inner surface is primarily nonconductive, provides for supporting circuit elements directly in engagement with the inner surface of the package without the risk of short circuiting between circuit terminals and does not require additional packaging structure for supporting the circuit elements.

Figure 4:
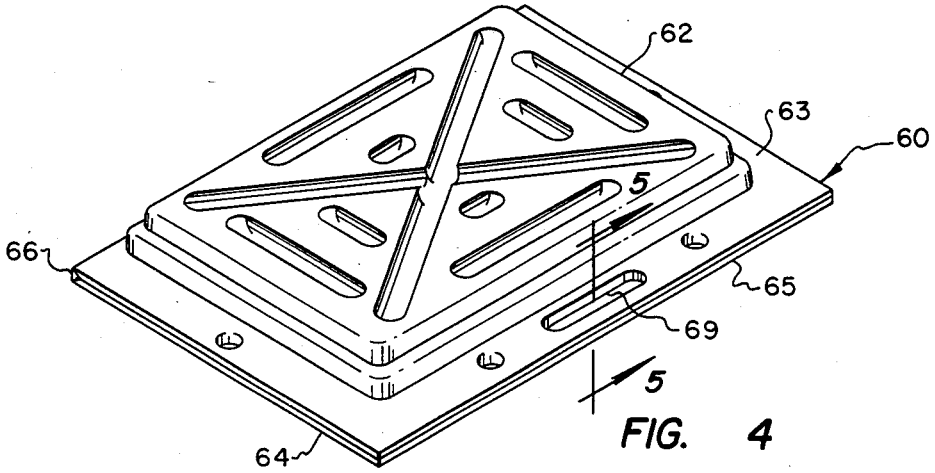
FIG. 4 is a perspective view of an alternate embodiment of a conductive circuit board container in accordance with the present invention.
Figure 5:
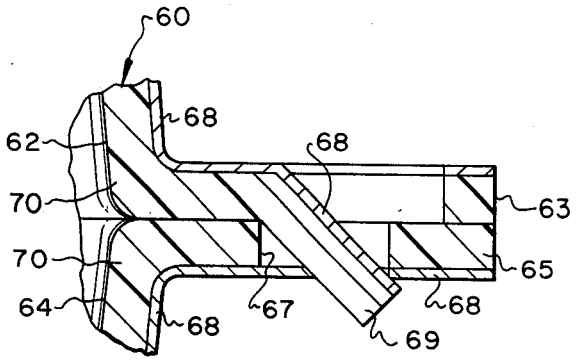
FIG. 5 is a detailed section taken along the line 5—5 of FIG. 4.

Referring now to FIGS. 4 and 5, an alternate embodiment of the present invention, in the form of an electrically conductive circuit element storage container, is illustrated and generally designated by the numeral 60. The container 60 is also provide with opposed clamshell type sections 62 and 64 which are joined together by an integral hinge portion 66. The package 60 may comprise a container substantially like that of the embodiment described in conjunction with FIGS. 1–3 except a peripheral flange 63 on the section 62 and a cooperating peripheral flange 65 on the section 64 are formed with cooperable fastener means comprising at least one elongated slot 67 formed in the flange 65 for receiving a flexible tab or tongue part 69 comprising a portion of the flange 63 which has been cut generally on three sides to permit displacement of the tab as shown into and through the slot 67 for engagement with the exterior surface of a portion of the flange 65, and as indicated by numeral 68 in FIG. 5. The container 60 is also preferably formed of a thermoformed foamed plastic such as styrene foam sheet which has been heated and then thermoformed into the shape shown. The container 60 is thus formed of a formed plastic sheet 70 to which a conductive coating 68 has been applied directly to the foamed plastic. The coating 68 may comprise vacuum deposited metals such as aluminum or a sprayed on coating of suspended carbon particles in a suitable binder to form a particle retaining film.

Figure 6:
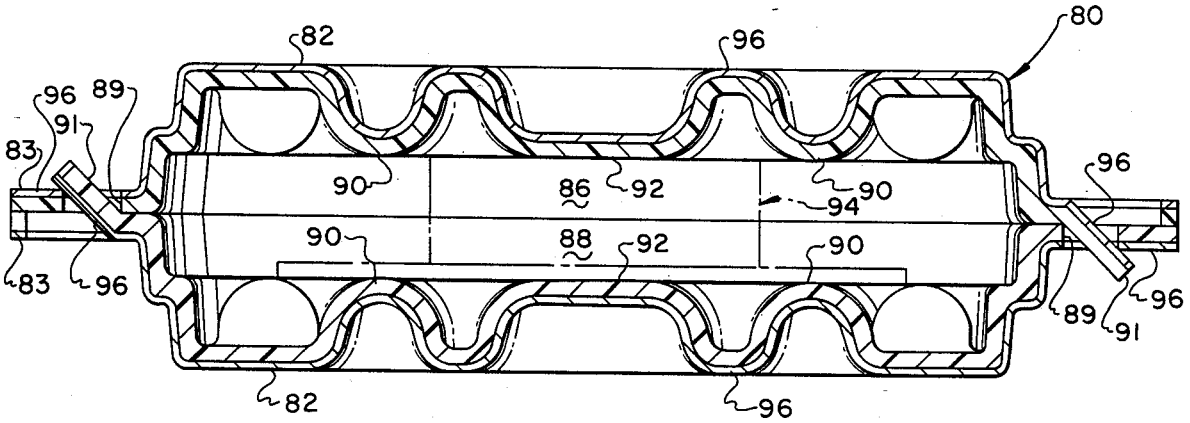
FIG. 6 is a transverse section view of a second alternate embodiment of a circuit board container in accordance with the present invention.

Referring now to FIG. 6, a second alternate embodiment of an electrically conductive container for circuit boards and the like, is illustrated in transverse cross section similar to FIG. 2 and generally designated by the numeral 80. The container 80 comprises two opposed container sections 82 which are formed to have displaced walls providing recesses 86 and 88 and a pattern of support bosses 90 and 92, respectively, for providing strength and rigidity to the package as well as for supporting an electrical circuit element such as a circuit board 94 within the recesses 86 and 88. The package sections 82 are also provided with peripheral flanges 83 which, along opposed sides, are provided with respective slots 89 and integral bendable tongue parts 91, respectively. The tongue parts 91 are adapted to fit within the slots 89 in the same manner as that illustrated in FIG. 5. The exterior surfaces of the container sections 82 are coated with a layer of electrically conductive material 96 and the engagement of the tongue parts 91 with the exterior surfaces of the opposed flanges 83 assures that an electrically conductive path is established between the package sections 82 over the entire exterior surface thereof. Accordingly, a thermoformed plastic, electrically conductive container may also be formed of two separate package sections which can be joined together in electrically conductive relationship to each other and which are adapted for high volume, low cost production. The container 80 enjoys most of the same advantages as the electrically conductive packages described in conjunction with FIGS. 1–5.

Figure 7:
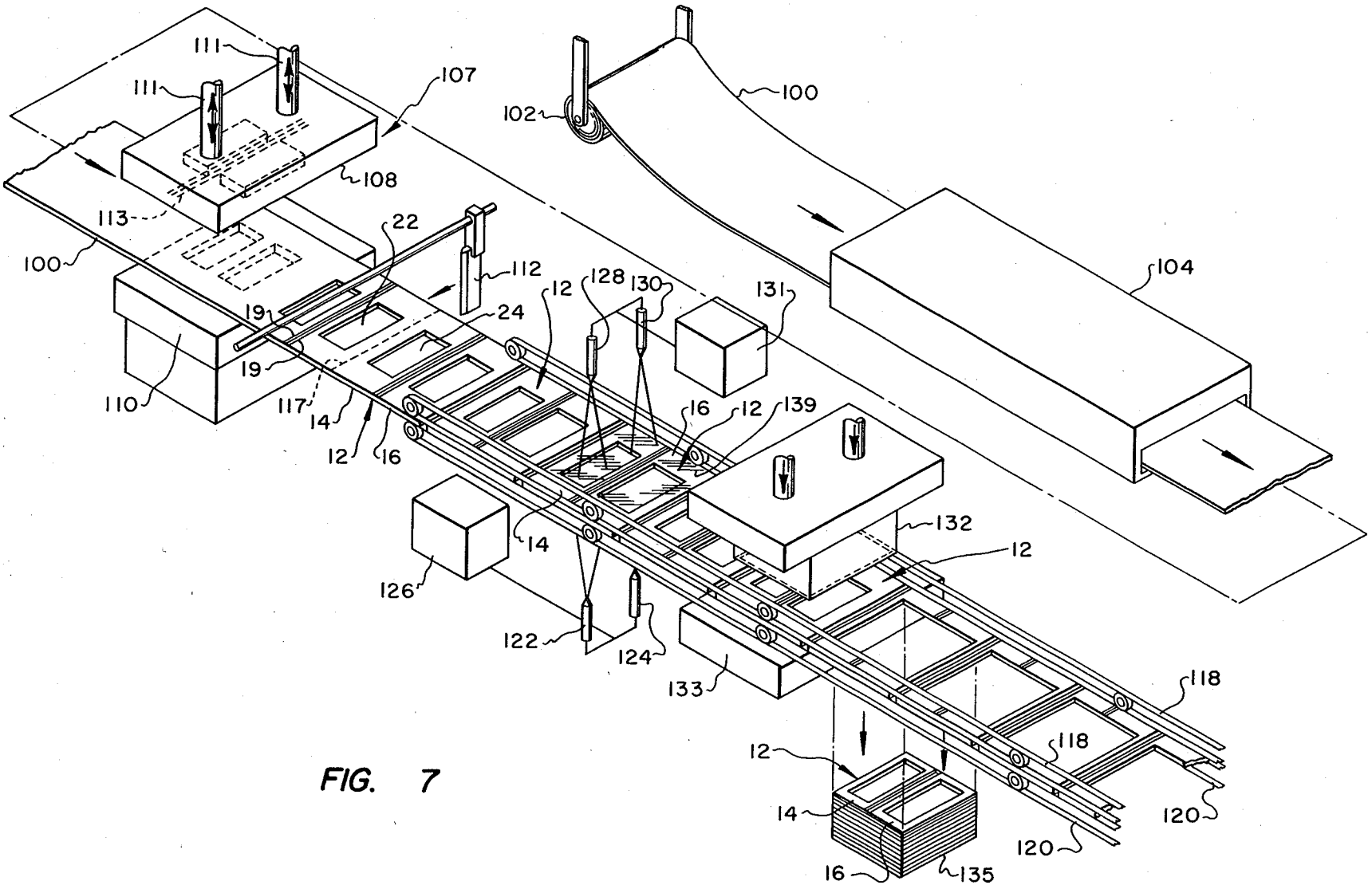
FIG. 7 is a schematic diagram of a manufacturing system for manufacturing the circuit board packages in accordance with an improved method of the present invention.

Referring now to FIG. 7, there is illustrated, in schematic form, a system for forming the improved conductive circuit board package of the present invention in accordance with an improved method of providing such a package. FIG. 7 illustrates, in schematic form, apparatus for processing material such as extruded plastic foam sheet to a finished container such as the container 12. Laminated or unlaminated polystyrene foamed plastic sheet 100 may be supplied on a continuous roll 102 suitably supported for unrolling the sheet and feeding same through an elongated oven 104 whereby the sheet is uniformly heated by convection and/or radiation. The oven 104 is preferably on the order of three to four times the length of the finished package container to be manufactured by the system illustrated in FIG. 7. After passing through the oven 104, the sheet 100 is passed between an assembly 107 of matched thermoforming mold members comprising a so called male die member 108 and a female mold or die cavity member 110. Suitable reciprocable rams 111 are conducted to the forming die member 108 for movement toward the cavity member 110 whereby the sheet material is displaced to simultaneously form the recesses 22 and 24 of the respective package sections 14 and 16 and the array of bosses 26, 28, 30, 31 and 32 as well as the bosses 27 and the recesses 29. The forming die and mold cavity structure 108–110 may also be provided with suitable scoring means 113 for forming the score lines 19 to form the hinge section 18. As the sheet 100 is fed into proximity to the matched mold assembly 107, the sheet is intermittently arrested in its feeding movement provided by feed rollers or tractor means, not shown, whereby the rams 111 for actuating the forming die 108 are operable to move toward and away from the cavity 110 to form the recesses 22 and 24 and associated bosses and the score lines 19 for a container 12. Subsequent to the formation of the displaced sheet portions forming a container 12, the sheet 100 may be severed along a transverse edge 117 by a reciprocable double edged cutting knife 112 to form a transverse detachment from the continuous roll.

Subsequent to formation of the container 12 in its open position, each container is then fed to conveyor means comprising opposed pairs of endless conveyor belts 118 and 120 arranged to grip the sides of the container 12 along what has become opposite sides of the flanges 15 and 17 to feed the containers 12 along the conveyor means and whereupon a suitable electrically conductive coating may be applied to the outer surfaces of the sections 14 and 16. As illustrated in FIG. 7, spaced apart spray nozzles 122 and 124 are connected to a reservoir 126 containing a quantity of liquid composition of the type described herein which, by suitable pump means, not shown, may be injected through the spray nozzles 122 and 124 to be sprayed onto the entire outer surface of the container sections 14 and 16. In the embodiment of the electrically conductive package illustrated and described herein, an electrically conductive coating such as the coating 46, is applied only to the outer surface of the package. Those skilled in the art will appreciate that a second set of nozzles 128 and 130 may be arranged to spray a coating 139 on the entire surface of the opposite side of the containers 12 as they pass through the conveyor system. The coating 139 may be electrically conductive or may comprise an antistatic type coating supplied from a reservoir 131. Suitable drying apparatus for accelerating the drying of the paint composition may be provided, not shown, to accelerate the drying of the coatings 46 and 139.

After application of the coating 46 or a similar suitable coating or coatings, the containers 12 pass to a trimming apparatus comprising an anvil 130 and a cutting die 132 which is reciprocable with respect to the anvil for cutting the containers 12 to final form to trim the flange traction edges engageable with the conveyor belts and, if an embodiment in accordance with FIGS. 4–6 is being fabricated, the trimming die 130, 132 will also form the slots and tab or tongue portions on the respective container flanges. The containers may then be deposited in a stack 135 for shipment to a point of use.

In the further development of the present invention it has been determined that a container having a conductive coating over the entire outer surface of the container, over the entire inner surface of the container or both may be susceptible to retaining a static electrical charge if the coatings on the inner and outer surfaces are not interconnected to provide for dissemination of an electrical charge from the entire exterior surfaces of the material of which the container is made.

Figure 8:
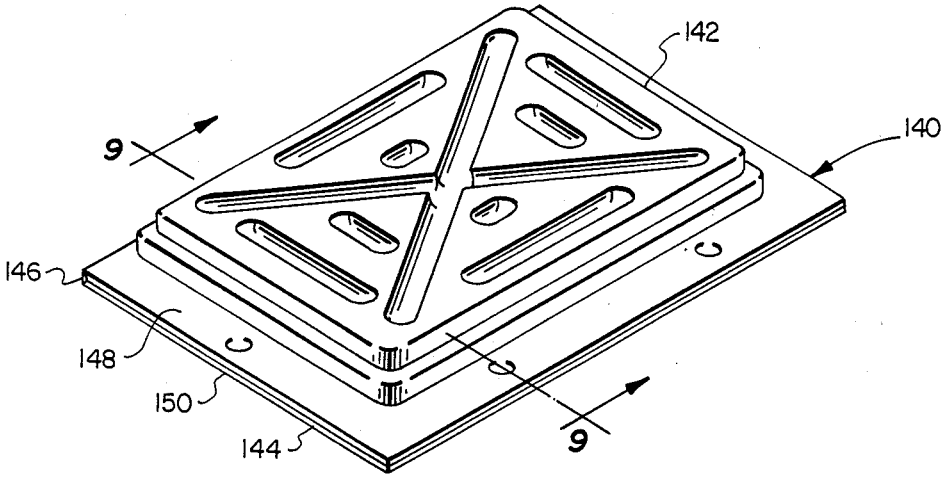
FIG. 8 is a perspective view of a third alternate embodiment of a circuit board container in accordance with the present invention.
Figure 9:
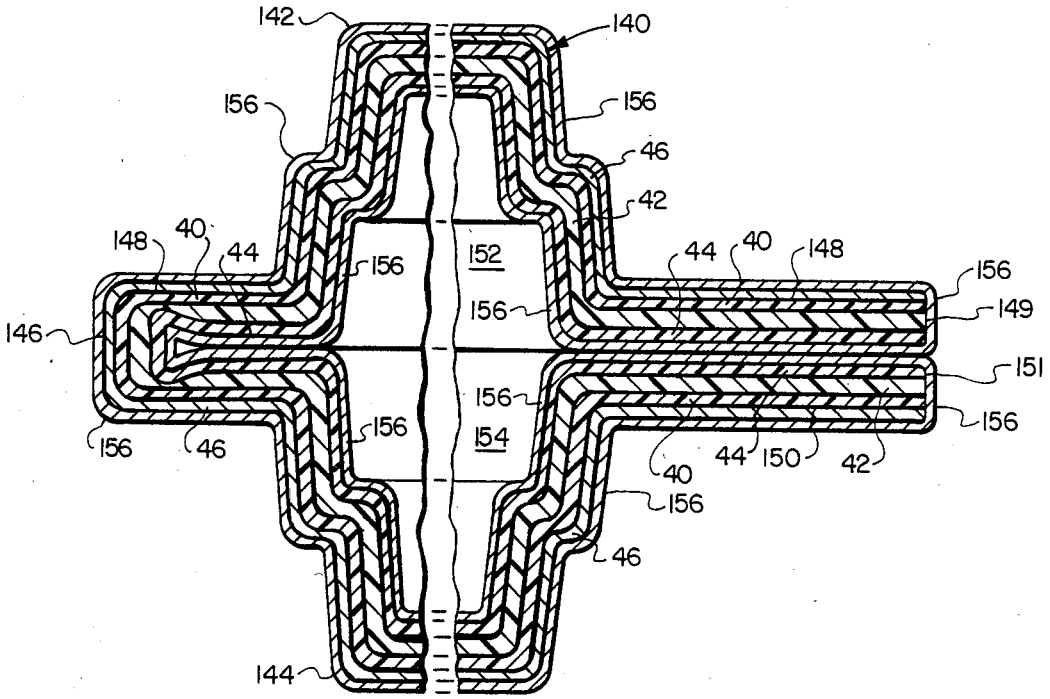
FIG. 9 is a section view taken along the line 9—9 of FIG. 8.

Referring to FIG. 8, for example, a third alternate embodiment of an electrically conductive circuit board package is illustrated and generally designated by the numeral 140 having opposed clamshell top and bottom sections 142 and 144 which are joined by an integral hinge 146. The formation of the clamshell sections 142 and 144 also provides generally peripheral mating flanges 148 and 150. As shown in FIG. 9 the clamshell sections 142 and 144 provide interior recesses 152 and 154 similar to the recessed formed in the interior of the container 12. The container 140 may, in fact, be structurally identical to the container 12 and further detailed description of the structural features of the container 140 are not believed to be necessary to enable one to practice the present invention.

As shown in FIG. 9 the container 140 is also preferably fabricated from thermoformed polystrene plastic sheet having a relatively hard plastic outer sheet 40 a foamed core portion 42 and a relatively hard plastic inner sheet 44. The sheets 40 and 44 are suitably laminated to the core 42. As shown in FIG. 9, the container 140 is provided with a continuous electrically conductive coating 46 applied to the outer surface of the sheet 40 and which extends over the entire outer surfaces of the clamshell sections 142 and 144, the flanges 148 and 150 and the integral hinge section 146. Moreover, to reduce the possibility of creating a capacitive type structure of the container wall comprising the plastic layers 40, 42 and 44 a coating 156 is applied to the entire inner and outer surfaces of the clamshell sections 142 and 144 and the peripheral flanges 148 and 150. In essence, the entire structure of the container 140 is encapsulated by the coating 156 including the peripheral edges 149 and 151 of the flanges 148 and 150. Accordingly, since the coating 156 extends at least between the inner and outer surfaces of the container structure as defined by the sheets 40 and 44 a conductive path is provided which prevents the formation of an electrostatic charge on either the inner or outer surfaces of the container in the event that one of the surfaces comes into contact with a conductive surface.

The coating 156 may be a relatively highly conductive coating similar to the coating 46 or may be primarily an antistatic coating such as a type commercially available from the American Cyanamid Company and their CYASAT 609 antistatic coating. Conceivably, the antistatic coating can be applied by either totally immersing the container after its fabrication in a bath of the coating liquid, by spraying the coating on the entire exposed surface area of the container 140 or by mixing the coating with the feed stock which is utilized in forming the hard plastic layers 40 and 44 and the form core layer 42.

Figure 10:
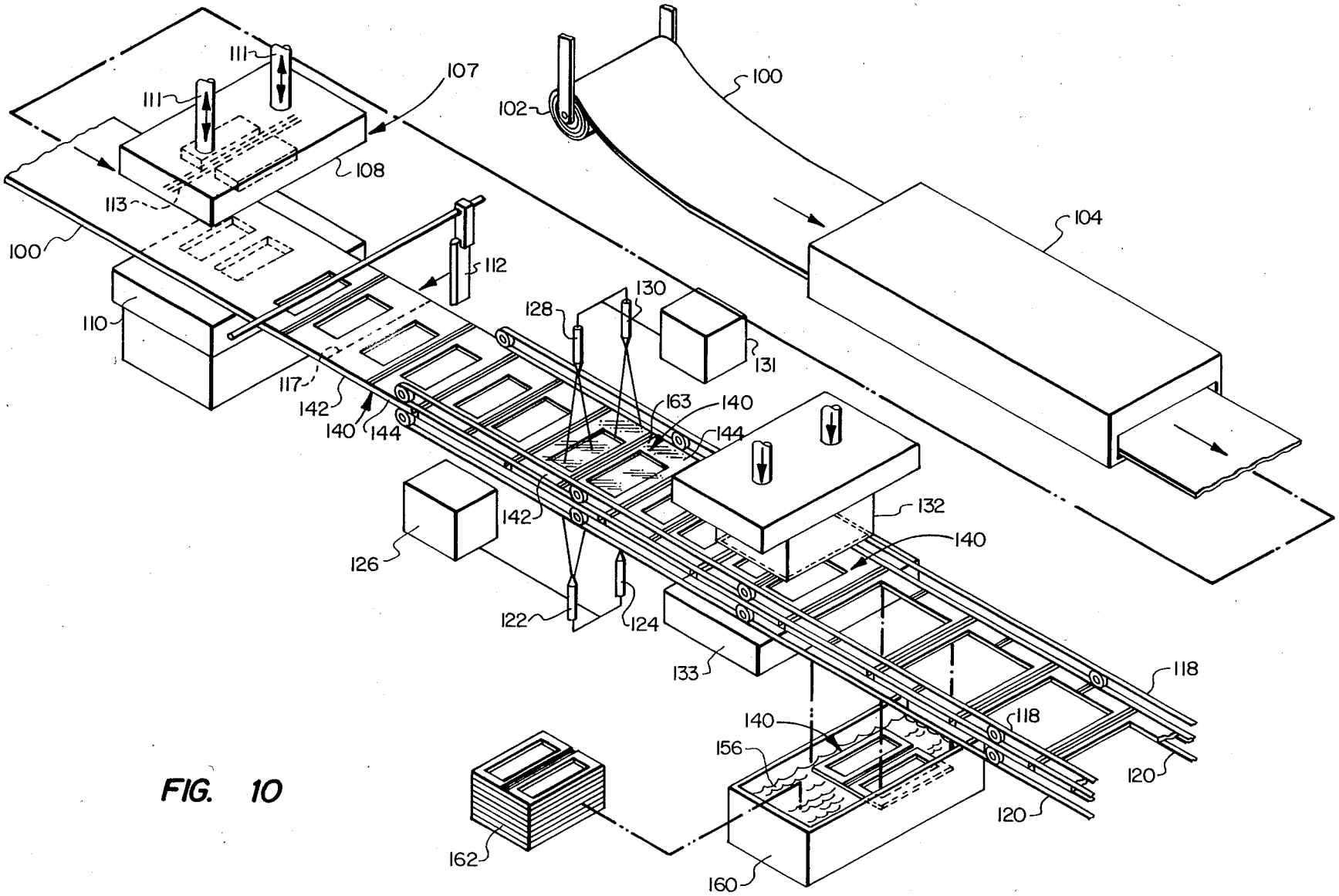
FIG. 10 is a schematic diagram of a manufacturing system similar to that illustrated in FIG. 7 for manufacturing the container of FIGS. 8 and 9.

Referring now to FIG. 10 there is illustrated a modified system for forming the container 140 comprising all of the components of the system illustrated in FIG. 7 and which bear the same reference numerals. The system illustrated in FIG. 10, however, has been modified by the provision of an immersion vat 160 containing a quantity of the coating material 156 in liquid form to form a bath into which the container 140 may be totally immersed so that the coating is applied to the entire surface of the container to essentially encapsulate the container. The containers 140 are then removed from the vat 160 by suitable means, not shown, dried and placed in a nested stack 162 similar to the stack 135 for shipment to a point of use or to storage awaiting use. As indicated in FIG. 10, the coating 156 is, of course, applied after the container 140 are die cut from the sheet 100 so that the peripheral edges of the flanges 148 and 150 are assured of being coated with the coating 156 to provide a continuous conductive or antistatic surface.

As indicated in FIG. 10, the containers 140 may be provided with the conductive coating 46 through the nozzles 122 and 124 over the entire outer surface of the clamshell sections 142 and 144 and a conductive coating 163 may be applied by the nozzles 128 and 130 from the reservoir 131. The steps of thermoforming the recessed portions of the clamshell sections 142 and 144 using the assembly 107 together with the formation of suitable score lines for defining the integral hinge section 146 may be carried out in the same manner as described for the process of manufacturing the containers 12 in conjunction with the system shown in FIG. 7.

Those skilled in the art will appreciate that a mass produceable, low cost, electrically conductive package may be produced in accordance with the present invention utilizing the methods described in conjunction with the systems of FIGS. 7 and 10 to provide a superior integral container having a continuous electrically conductive surface to minimize the buildup of electrostatic charges.

Although preferred embodiments of the invention have been described herein in conjunction with the drawing, those skilled in the art will recognize that various substitutions and modifications may be made to the invention, in the improved conductive package and the method of manufacture, without departing from the scope and spirit of the invention as recited in the appended claims.

What we claim is:

1. A package for an electrical circuit device having an electrically conductive surface forming a shield to prevent electrical charges from adversely affecting said circuit device, said package comprising a container formed from impact resistant and shock dissipating thermoformed plastic, said container including opposed top and bottom sections, said top and bottom sections forming means for supporting said circuit device in said container and said top and bottom sections being joined by an integral hinge section, and electrically conductive surface means on the exterior of said top, bottom and hinge sections of said container and forming a substantially continuous conductive path between said top and bottom sections through said hinge section.

2. The package set forth in claim 1 wherein:
said top and bottom sections include cooperable fastener means engageable to secure said top and bottom sections to each other and to provide an electrically conductive path between said top and bottom sections.

3. The package set forth in claim 1 wherein:
said conductive surface means comprises a conductive coating applied to a surface of said plastic sheet.

4. The package set forth in claim 3 wherein:
said coating comprises carbon particles sprayed on said outer layer in a liquid paint composition.

5. The package set forth in claim 3 wherein:
said coating comprises vacuum deposited metal.

6. The package set forth in claim 3 wherein:
said coating is applied to an inner surface of said sections.

7. The package set forth in claim 3 wherein:
said coating is applied to inner and outer surfaces of said sections and to a peripheral edge of at least one of said sections to form a continuous conductive path between said surfaces.

8. The package set forth in claim 1 wherein:
said plastic sheet includes a hard plastic outer layer and a foamed plastic core, and said conductive surface means comprises a conductive coating applied to said outer layer and forming the exterior surface of said container.

9. The package set forth in claim 1 wherein:
said top and bottom sections include cooperable fastener means, and each of said top and bottom sections including electrically conductive surface means on said fastener means engageable with electrically conductive surface means on the other section when said top and bottom sections are secured together by said fastener means.

10. The package set forth in claim 1 wherein:
said top and bottom sections include recesses formed therein and projection means disposed in said recesses for supporting said circuit device against movement in said container 11. The package set forth in claim 1 including:
an antistatic coating covering the entire exposed surfaces of said container including inner and outer surfaces of said sections and at least a portion of a peripheral edge of one of said sections.

12. A package for storing and shipping an electrical circuit board and the like, said package having means forming an electrically conductive shield to prevent electrostatic discharges to said circuit board, said package comprising:
an impact absorbing plastic container having opposed clamshell top and bottom section each configured to provide a recess for said circuit board, means for securing said circuit board in said recesses against substantial movement relative to said sections, said sections being joined together along an integral hinge portion to form a continuous part having a continuous outer surface extending between said sections, and an electrically conductive coating on said continuous outer surface including said hinge portion and forming an electrically conductive path between said sections for conducting electrical charges away from said package to provide said shield.

13. The package set forth in claim 12 wherein:
said container is formed by thermoforming a plastic sheet to form said sections and said integral hinge portion.

14. The package set forth in claim 13 wherein:
said hinge portion is defined by scoring said sheet along a portion forming an inner surface of said container.

15. The package set forth in claim 12 including:
an antistatic covering both inner and outer surfaces of said sections and at least a portion of an edge of one of said sections for providing a continuous coating between said inner and outer surfaces to prevent an electrical potential between said surfaces.

16. A method of continuously manufacturing a plurality of an electrically conductive package for electrical circuit boards and the like comprising:
providing a sheet of structural foamed plastic;
passing said sheet through oven means to heat said sheet to a forming temperature;
thermoforming said sheet by displacing spaced apart portions of said sheet to form opposed recesses in said sheet;
applying an electrically conductive coating to at least one surface of said sheet defining said package; and
separating a portion of said sheet including said opposed recesses to form a container having opposed top and bottom sections and an integral hinge portion interconnecting said sections and with said coating disposed on the outer surface of said hinge portion and said sections comprising said package.

17. The method set forth in claim 16 wherein:
said coating is applied to said sheet by spraying a carbon particle containing paint composition to one side of said sheet.

18. The method set forth in claim 17 including the step of:
die cutting said sheet to form the peripheral outline of said containers after applying said coating.

19. The method set forth in claim 18 including the step of:
applying an antistatic charge coating to the entire exposed surface area of said containers after die cutting said sheet to form said containers.

20. The method set forth in claim 16 including the step of:
applyng a coating to both sides of said package and to a portion of said package contiguous with both sides to prevent the formation of an electrostatic charge on said package.

21. The method set forth in claim 16 including the step of:
scoring a surface of said sheet between said recesses and on an inner surface of said containers to define said hinge portion.

22. The method set forth in claim 16 including the step of:
mixing an antistatic charge forming material into said foamed plastic prior to forming said sheet.

23. A package for storing and shipping an electrical circuit board and the like, said package having means forming an electrically conductive sheld to prevent electrostatic discharges to said circuit board, said package comprising:
an impact absorbing plastic container having opposed top and bottom sections for enclosing said circuit board, means for securing said circuit board against substantial movement relative to said sections, said sections being joined together along an integral hinge portion, said sections, said means for securing said circuit board and said hinge portion being formed integral by thermoforming a plastic sheet, said sheet including a relatively hard plastic outer layer and a foamed plastic core forming an impact resistant and shock dissipative structure, said outer layer forming a continuous outer surface extending between said sections through said hinge portion, and an electrically conductive coating on said continuous outer surface forming an electrically conductive path between said section for conducting electrical charges away from said package to provide said shield.

24. A package for storing and shipping an electrical circuit board and the like, said package having means forming an electrically conductive shield to prevent electrostatic discharges to said circuit board, said package comprising:

an impact absorbing container having opposed top and bottom sections for enclosing said circuit board, means for securing said circuit board against substantial movement relative to said sections, said sections being joined together in such a way as to form a continuous outer surface extending betweem said sections, an electrically conductive coating on said continuous outer surface forming an electrically conductive path between said sections for conducting electrical charges away from said package to provide said shield, and an antistatic coating applied to inner and outer surfaces of said container and over said electrically conductive coating and to at least a portion of an edge of one of said sections to form a continuous surface of said antistatic coating between said inner and outer surface of said container.

* * * * *